US005241343A

United States Patent [19]

Nishio

[11] Patent Number: 5,241,343

[45] Date of Patent: Aug. 31, 1993

[54] CONDUCTIVE FOAM RUBBER ROLLER USED IN IMAGE FORMATION APPARATUS SUCH AS ELECTROPHOTOGRAPHIC APPARATUS

[75] Inventor: Yukio Nishio, Kurume, Japan

[73] Assignee: Fujitsu Limited, Kawasaki, Japan

[21] Appl. No.: 971,214

[22] Filed: Nov. 4, 1992

[30] Foreign Application Priority Data

Nov. 6, 1991 [JP] Japan ..... 3-289768

[51] Int. Cl.[5] ..... G03G 15/02; G03G 15/14; G03G 15/06; G03G 21/00

[52] U.S. Cl. ..... 355/219; 355/259; 355/271; 355/296

[58] Field of Search ..... 355/259, 219'296, 271, 355/274, 245

[56] References Cited

U.S. PATENT DOCUMENTS 3,866,572 2/1975 Gundlach .
4,116,894 9/1978 Lentz et al. ..... 521/94
4,309,803 1/1982 Blaszak .
4,967,231 10/1990 Hosoya et al. ..... 355/219
5,057,871 10/1991 Hirose et al. ..... 355/259
5,062,385 11/1991 Nishio et al. ..... 355/259 X
5,076,201 12/1991 Nishio et al. ..... 355/259 X
5,097,294 3/1992 Nishio et al. ..... 355/245
5,164,773 11/1992 Nishio et al. ..... 355/245
5,168,313 12/1992 Hosaka et al. ..... 355/274

*Primary Examiner*—R. L. Moses
*Attorney, Agent, or Firm*—Staas & Halsey

[57] ABSTRACT

A conductive foam rubber roller is used as a charging roller, developing roller, toner-removing roller, or transfer roller in an image formation apparatus such as an electrophotographic recording apparatus, and comprises a tubular roller element made of a conductive foam rubber material and having a central bore defined by a solid skin layer having an electric resistivity considerably higher than that of a foam structure of the rubber element, and a conductive shaft on which the roller element is mounted and fixed. End sections of the skin layer are removed from the roller element such that the foam structure thereof is in direct contact with the shaft at end sections of the bore thereof. Alternatively, a conductive disc-like member having a central opening formed therein is inserted onto the shaft to be abutted against an end face of the roller element, whereby sufficient electric contact can be established between the roller element and the shaft.

12 Claims, 8 Drawing Sheets

CONDUCTIVE FOAM RUBBER ROLLER USED IN IMAGE FORMATION APPARATUS SUCH AS ELECTROPHOTOGRAPHIC APPARATUS

BACKGROUND OF THE INVENTION

1) Field of the Invention

The present invention relates to a conductive foam rubber roller used in an image formation apparatus such as a copying machine, a laser printer, a facsimile or the like, in which an electrostatic latent image is electrostatically developed with a developer.

2) Description of the Related Art

Generally, in an image formation apparatus such as an electrophotographic recording apparatus, the following processes are typically carried out:

a) a uniform distribution of electrical charges is produced on a surface of an electrostatic latent image carrying body;

b) an electrostatic latent image is formed on a charged area of the body surface by an optical writing means such as a laser beam scanner, an LED (light emitting diode) array, a liquid crystal shutter array or the like;

c) the latent image is developed as a visible image with a developer or toner, which is electrically charged to be electrostatically adhered to the latent image zone;

d) the developed and charged toner image is electrostatically transferred from the body to a recording medium such as a cut sheet paper; and e) the transferred toner image is fixed and recorded on the cut sheet paper by a toner image fixing means such as a heat roller.

Typically, the electrostatic latent image carrying body may be an electrophotographic photoreceptor, usually formed as a drum, called a photosensitive drum, having a cylindrical conductive substrate and a photoconductive insulating film bonded to a cylindrical surface thereof. In the charging process, an electric discharger such as a corona discharger is widely used to produce the charged area on the photosensitive drum, and this type of discharger is also used in the transferring process in which the developed and charged toner image is electrostatically transferred from the drum to the paper. The electric discharger has an inherent defect in that ozone is produced during the energizing thereof. Not only is ozone injurious to the health, but also it causes a premature deterioration of the drum and other parts of the electrophotographic recording apparatus.

For this reason, in place of the electric discharger, a conductive foam rubber roller is recently used as an electric charging roller in the charging and transferring processes. The electric charging roller is in contact with the photosensitive drum, and is connected to a suitable electric source so that the drum or the paper is charged with a desired polarity. Of course, during the charging of the drum or the paper by the electric charging roller, no ozone is produced.

Note, the electric charging roller must be resiliently pressed against the drum to obtain a given contact or nip width therebetween, before the drum or the paper can be sufficiently charged by the electric charging roller.

As one type of developer, a non-magnetic type one-component developer is known, which is composed of only a toner component (colored fine synthetic resin particles). In a developing device using this type developer, a conductive foam rubber roller may be used as a developing roller. The conductive developing roller is rotated within a body of the developer held by a vessel, and a portion of the developing roller exposed therefrom and is in contact with the photosensitive drum. In the developing process, the toner particles are frictionally entrained by the developing roller to be brought to the surface of the photosensitive drum for development of the latent image. In this case, in the developing device using the one-component developer, it is necessary to bring the toner to the drum at a uniform thickness before an even development of the latent image can be obtained. Namely, a uniform layer of the toner must be formed around the developing roller. To this end, the developing device is provided with a blade member engaged with the surface of the developing roller, to uniformly regulate a thickness of the toner layer formed therearound. The blade member also serves to electrically charge the toner particles by a triboelectrification therebetween, and a material of the blade member is selected such that the toner is charged with a desired polarity. Alternatively, the blade member is formed of a conductive material such as metal, and is connected to a suitable electric source to electrically charge the toner particles by a charge-injection effect. During the developing process, the developing roller is supplied with a developing bias voltage from a suitable electric source so that the charged toner particles are electrostatically attracted to only the latent image zone.

Note, a toner density of the developed toner image depends upon a contact or nip width between the developing roller and the photosensitive drum. Namely, in general, the larger the nip width between the roller and the drum, the higher the toner density of the developed image. Accordingly, the developing roller must be pressed against the drum at a suitable liner pressure before it is possible to obtain a proper density of the developed toner image.

The developing device may also include another conductive foam rubber roller used as a toner-removing roller. The toner-removing roller is resiliently pressed against the developing roller, and is rotated in the same direction as the developing roller so that the surfaces of the rollers rub against each other in reverse directions at a contact zone therebetween, whereby residual toner particles not used for the development of the latent image are mechanically removed from the developing roller. The toner-developing roller is supplied with a voltage from a suitable electric source so that a penetration of the charged toner particles into the toner-removing foam rubber roller is electrostatically prevented.

The conductive foam rubber roller used as the charging roller and the developing roller must have a suitable softness so that an operating life of the photosensitive drum can be extended as long as possible, because the harder the conductive foam rubber roller which is resiliently pressed against the drum, the greater a wear of the photoconductive insulating film of the drum. Also, the conductive foam rubber roller used as the toner-removing roller should have a suitable softness, because, if the toner-removing roller is harder than the developing roller, the latter is prematurely worn by the toner-removing roller which is resiliently pressed thereagainst. Furthermore, the conductive foam rubber roller must have pore openings a diameter of which is at most twice an average diameter of the toner particles, so that a penetration of the toner particles thereinto can be effectively prevented, because the roller is hardened by this penetration. Since typically the toner particles have an average diameter of about 10 μm, the pore openings of the roller should be given a diameter of less than 20 μm, preferably 10 μm.

Conventionally, the conductive foam rubber roller having pore openings, the diameter of which is less than 20 μm, may be produced by the following processes:

a) a suitable resin material, e.g., polyurethane, silicone, acrylonitrile-butadiene or the like, containing a conductive substance such as carbon or a fine metal powder, and a water-soluble foam-providing substance such as polyvinyl alcohol or methyl cellulose is extruded as a long tubular product;

b) the extruded tubular product is immersed in a body of water held by a container, and thus the water-soluble foam-providing substance dissolves in the body of water so that a foam structure is given the tubular product;

c) the tubular foam product is cut into tubular roller elements having a predetermined length; and d) the tubular roller element is mounted and fixed on a metal shaft member by using a suitable adhesive such as a thermosetting adhesive, to thereby produce a conductive foam rubber roller.

This conductive foam rubber roller must be further treated before it can be used as a charging roller, developing roller, or toner-removing roller as mentioned above, because the tubular roller element is covered at an outer surface thereof by a solid skin layer having a thickness of about 1 to 5 μm and the content of the conductive substance is very small in comparison with that of the conductive substance in the internal foam structure of the tubular element. Namely, the conductive foam rubber roller is finished by removing the solid skin layer from the tubular roller element thereof.

Nevertheless, many of the finished conductive foam rubber rollers cannot have a desired electric characteristic when an electric energy is applied to the tubular roller element through the metal shaft member, due to an existence of an inner solid skin layer formed at an inner wall surface of the central bore of the tubular roller element. In particular, an electric resistivity of the inner solid skin layer is considerably higher than that of the foam structure of the tubular roller element because a content of the conductive substance therein also is very small, and a thickness of the inner solid skin layer is variable along a longitudinal axis of the metal shaft member. Thus, an electric potential of the tubular roller element, which is obtained by the application of the electric energy to the tubular roller element through the metal shaft member, is also variable along the longitudinal axis of the metal shaft member. Accordingly, for example when this defective conductive foam rubber roller is used as a developing roller, it is impossible to obtain an even development of the latent image.

SUMMARY OF THE INVENTION

Therefore, an object of the present invention is to provide a conductive foam rubber roller used in an electrophotographic recording apparatus, which comprises a conductive tubular foam rubber roller element having a central bore defined by a solid skin layer having an electric resistivity considerably higher than that of a conductive foam structure of the conductive tubular foam rubber element, and a conductive shaft member on which the conductive foam rubber roller element is mounted and fixed, wherein the conductive foam rubber roller has a desired electric characteristic when an electric energy is applied to the tubular roller element through the metal shaft member, regardless of an existence of a solid skin layer.

In accordance with the present invention, there is provided to a conductive foam rubber roller used in an electrophotographic recording apparatus comprising: a conductive tubular foam rubber roller element having a central bore defined by a solid skin layer having an electric resistivity considerably higher than that of a conductive foam structure of the conductive tubular foam rubber element; a conductive shaft member on which the conductive foam rubber roller element is mounted and fixed; and an electric contact establishing means provided between the conductive tubular foam rubber roller element and the conductive shaft member for establishing a sufficient electric contact therebetween.

According to one aspect of the present invention, the electric contact establishing means comprises a removal of end sections of the solid skin layer from the conductive tubular foam rubber roller element such that the conductive foam structure of the conductive tubular foam rubber roller element is in direct contact with the conductive shaft member at end sections of the central bore thereof.

According to another aspect of the present invention, the electric contact establishing means comprises a conductive disc-like member having a central opening formed therein to receive the conductive shaft member, the conductive disc-like member being inserted onto the conductive shaft member to be abutted against an end face of the conductive tubular foam rubber roller element, whereby sufficient electric contact can be established between the conductive tubular foam rubber roller element and the conductive shaft member. The conductive disc-like member may have a tongue element formed therein, a free end of which is slightly projected in the central opening of the conductive disc-like member, whereby the conductive disc-like member is prevented from slipping out of the conductive shaft member by an engagement of the tongue element with a surface of the conductive shaft member. Also, the conductive disc-like member may have a nail-like element formed therein and bent to be oriented toward the end face of the conductive tubular foam rubber roller element, and the nail-like element is penetrated into the conductive foam structure thereof when the conductive disc-like member is abutted against the end face of the conductive tubular foam rubber roller element. Preferably, an end portion of the conductive shaft member has a smaller diameter than that of a middle portion thereof on which the conductive tubular foam rubber roller element is fixed, so that an annular shoulder is formed in the conductive shaft member to be flush with the end face of the conductive tubular foam rubber roller element, and the central opening of the conductive disc-like member has a size so as to receive only the end portion of the conductive shaft member, whereby the conductive disc-like member is prevented from being moved beyond the annular shoulder of the conductive shaft member.

In the electrophotographic recording apparatus, the conductive foam rubber roller may be used as a charging roller for producing an electrically charged zone on an electrostatic latent image carrying body, a developing roller for electrostatically developing an electrostatic latent image with a toner developer, a toner-removing roller for mechanically removing a toner developer, which is not used for a development of an electrostatic latent image, from the developing roller, and as a transfer roller for electrostatically transferring a developed toner image from the electrostatic latent image carrying body to a recording medium such as a paper.

BRIEF DESCRIPTION OF THE DRAWINGS

Other objects and advantages of the present invention will be better understood from the following description, with reference to the accompanying drawings, in which.

DESCRIPTION OF THE PREFERRED EMBODIMENTS

Figure 1:
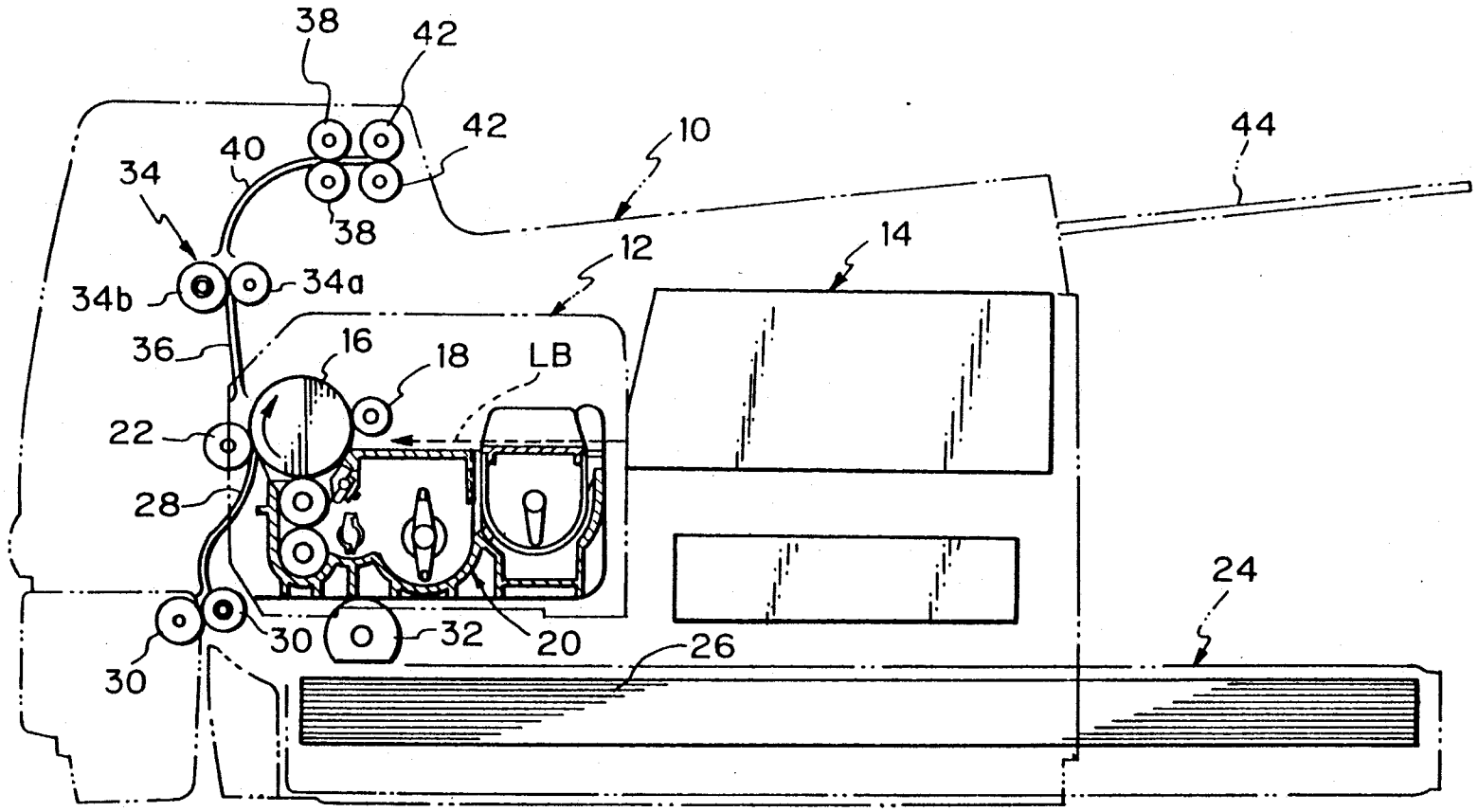
FIG. 1 is a schematic view showing an electrophotographic laser printer in which a conductive foam rubber roller according to the present invention is used.

FIG. 1 schematically shows a laser printer as an example of an electrophotographic recording apparatus, in which a conductive foam rubber roller according to the present invention is used. The laser printer comprises a printer housing 10, a printing unit 12 provided in the printer housing 10, and a laser beam scanner 14 disposed adjacent to the printing unit 12. The printing unit 12 includes a rotary photosensitive drum 16 as a latent image carrying body, which is rotated in a direction indicated by an arrow in FIG. 1 during an operation of the printer. For example, the drum 16 may be formed of an aluminum cylindrical hollow body and a photoconductive film composed of an organic photoconductor (OPC) and bonded to a surface of the hollow body.

The printing unit 12 also includes an electrically charging roller 18 which is resiliently pressed against the photosensitive drum 16 to produce a charged area on the drum 16. The the charging roller 18 is formed as a conductive foam rubber roller constituted according to the present invention, which may be made of a conductive polyurethane foam rubber material having, for example, a plurality of pore openings or cells having an average diameter of about 10 μm, a density of 200 cells/inch, an Asker hardness of 23 degs, and a resistivity of about $10^7$ Ω cm. The charging roller 18 is subjected to an application of an electric energy so that a charged area having, for example, a potential of −600 volts is produced on the surface of the drum 16.

The laser beam scanner 14 writes an electrostatic latent image on the charged area of the drum 16, and includes a laser source such as a semiconductor laser diode for emitting a laser light, an optical system for focusing the laser light into a laser beam LB, and an optical scanning system such as a polygon mirror for deflecting the laser beam LB along a direction of a central axis of the drum 16 so that the charged area of the drum 16 is scanned by the deflecting laser beam LB. During the scanning, the laser beam LB is switched on and off on the basis of binary image data obtained from, for example, a word processor, personal computer or the like, so that an electrostatic latent image is written as a dot image on the charged area of the drum 16. In particular, when a zone of the charged area is irradiated by the laser beam LB, the charges are released from the irradiated zone so that a potential thereof is changed from about −600 volts to about −100 volts, whereby the latent image is formed as a potential difference between the irradiated zone and the remaining zone.

Figure 2:
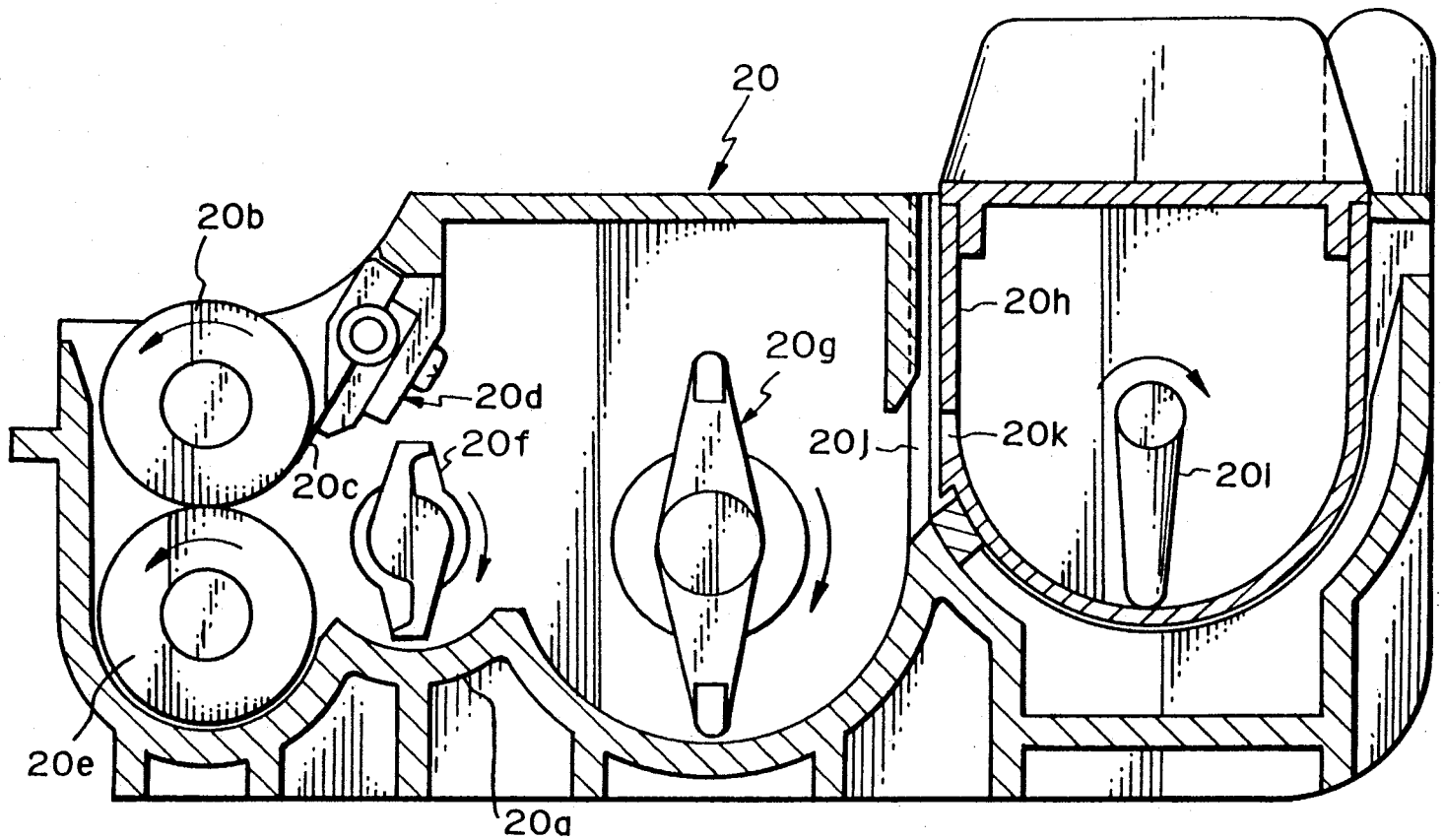
FIG. 2 is an enlarged view showing a developing device of the electrophotographic laser printer shown in FIG. 1.

The printing unit 12 further includes a toner developing device 20, which is best shown in FIG. 2, including a vessel **20*a* for holding a non-magnetic type one-component developer, and a developing roller 20*b* provided within the vessel 20*a* in such a manner that a portion of the developing roller 20*b* is exposed therefrom and pressed against the surface of the photosensitive drum 16. the developing roller 20***b* is also formed as a conductive foam rubber roller constituted according to the present invention, which may be made of a conductive polyurethane foam rubber material having, for example, a plurality of pore openings or cells having an average diameter of about 10 μm, a density of 200 cells/inch, an Asker hardness of 23 degs., and a resistivity of about from $10^4$ to about $10^7$ Ω cm. The developer may be composed of polyester resin-based toner particles having a resistivity of $4\times10^4$ Ω cm, and an average diameter of toner particles is 10 μm. The developing roller 20*b* is rotated in a direction indicated by an arrow in FIG. 2, and frictionally entrains the toner particles to form a developer or toner layer therearound, whereby the toner particles are brought to the surface of the drum 16 for a development of the latent image formed thereon. Note, the developing roller 20*b* formed of the polyurethane foam rubber material has an excellent property for entraining the toner particles and is very soft.

The developing device 20 also includes a blade member 20*c* supported by the vessel 20*a* through attachment fittings, generally indicated by reference 20*d*, such that the blade member 20*c* is engaged with a surface of the developing roller 20*b* to make a thickness of the toner layer formed therearound uniform, whereby an even development of the latent image can be ensured. The blade member 20*c* is formed of a conductive material such as metal, and is subjected to an application of a voltage so that the toner particles is negatively charged by a charge-injection effect. During the developing process, the developing roller 20*b* is subjected to a developing bias voltage of −300 volts, the negative charged toner particles are electrostatically adhered to only the latent image zone having the potential of about −100 volts, because the latent image zone is charged with the negative particles.

The developing device 20 further includes a toner-removing roller 20*e* rotatably provided within the vessel 20*a* and resiliently pressed against the developing roller 20*b*. The toner-removing roller 20*e* is rotated in the same direction as the developing roller 20*b*, as indicated by an arrow in FIG. 2, so that the surfaces of the rollers 20*b* and 20*e* are rubbed against each other in reverse directions at the contact zone therebetween, whereby residual toner particles not used for the development of the latent image are mechanically removed from the developing roller 20*b*. On the other hand, the toner-removing roller 20*e* serves to feed the toner particles to the developing roller at one side of the nip therebetween (i.e., the right side in FIG. 2), because the toner particles entrained by the toner-removing roller 20*e* are moved toward the nip between the rollers 20*b* and 20*e*. The toner-removing roller 20*e* is further formed as a conductive foam rubber roller constituted according to the present invention, which may be made of a conductive polyurethane foam rubber material having, for example, a density of 40 cells/inch, and a resistivity of about from $10^4$ Ω cm. The toner-removing roller 20*e* is subjected to an application of a voltage to thereby be negatively charged, so that a penetration of the toner particles thereinto can be prevented.

The vessel 20*a* may be provided with a paddle roller 20*f* and an agitator 20*g* rotated in directions indicated by arrows in FIG. 2, respectively. The paddle roller 20*f* serves to move the toner particles toward the toner-removing roller 20*e*, and the agitator 20*g* agitates the body of the toner to eliminate a dead stock thereof from the vessel 20*a*. Also, the vessel 20*a* may also be provided with a developer-supplying tank 20*h* detachably received therein and having a paddle blade 20*i* rotated in a direction indicated by an arrow in FIG. 2, and has an opening 20*j* formed in a side wall of the vessel 20*a*. The tank 20*h* has a port 20*k* formed therein, and the vessel 20*a* is in communication with the tank 20*h* through the opening 20*j* and the port 20*k* when the tank 20*h* is received in the vessel 20*a*, as shown in FIG. 2. When a predetermined amount of the developer is consumed from the vessel 20*a*, the rotation of the paddle blade 20*i* is carried out, whereby the developer is fed from the tank 20*h* to the vessel 20*a*.

The printing unit 12 includes a conductive roller type transfer charger 22 for electrostatically transferring the developed toner image from the photosensitive drum 16 to a recording medium such as a cut sheet paper. The transfer charger 22 is furthermore formed as a conductive foam rubber roller constituted according to the present invention, which may be made of a conductive polyurethane foam rubber material having, for example, a plurality of pore openings or cells having an average diameter of about 10 μm, a density of 200 cells/inch, an Asker hardness of 23 degs, and a resistivity of about $10^7$ Ω cm. Namely, the material of the transfer roller 22 may be identical with that of the charging roller 18. The transfer roller 22 is resiliently pressed against the drum 16, and is subjected to an application of an electric energy so that positive charges are supplied to the paper, whereby the negatively-charged toner image can be electrostatically attracted to the paper.

The printer further comprises a paper cassette 24 in which a stack of paper 26 is received, and a paper guide 28 extended from the paper cassette 24 toward a nip between the photosensitive drum 16 and the transfer roller 22, and a pair of register rollers 30, 30 incorporated in the paper guide 28. During the printing operation, papers to be printed are fed one by one from the stack of paper 26 into the paper guide 28 by driving a paper feeding roller 32 incorporated in the paper cassette 24. The fed paper is stopped once at the register roller 30, 30, and is then introduced into the nip between the drum 16 and the transfer roller 22 at a given timing, so that the developed toner image can be transferred to the paper in place. The paper discharged from the nip between the drum 16 and the roller 22, i.e., the paper carrying the transferred toner image is then moved toward a toner image fixing device 34 along a paper guide 36 extended between the transfer roller 22 and the fixing device 34, and is passed through a nip between a heat roller 34*a* and a backup roller 34*b* of the fixing device 34, whereby the transferred toner image is thermally fused and fixed on the paper.

The paper carrying the fixed toner image is moved toward a pair of guide rollers 38, 38 along a paper guide 40 extended between the fixing device 34 and the guide rollers 38, 38, and is then discharged from a pair of paper-discharging rollers 42, 42 adjacent to the guide rollers 38, 38 to a paper tray 44 provided on the printer housing 10. Note, in FIG. 1, reference numeral 46 indicates a controller, illustrated as a block, for the printer.

Figure 3:
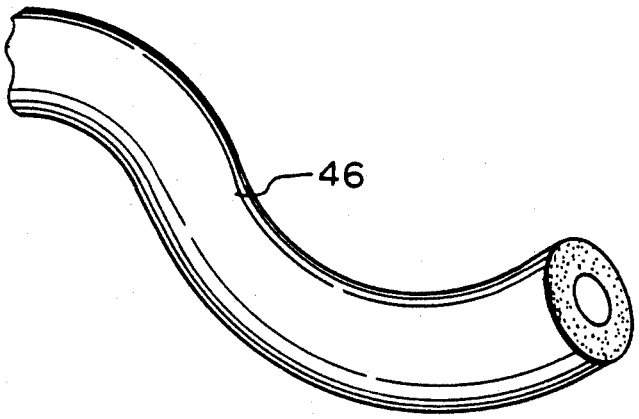
FIG. 3 is a perspective view showing an extruded long tubular product formed of a suitable resin material containing a conductive substance and a water-soluble foam-providing substance.
Figure 4:
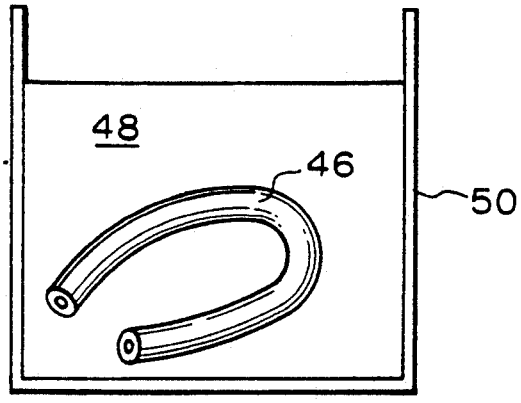
FIG. 4 is a schematic view showing a container holding a body of water in which the tubular product of FIG. 3 is immersed so that the water-soluble foam-providing substance dissolves in the body of water to produce a tubular foam product.
Figure 5:
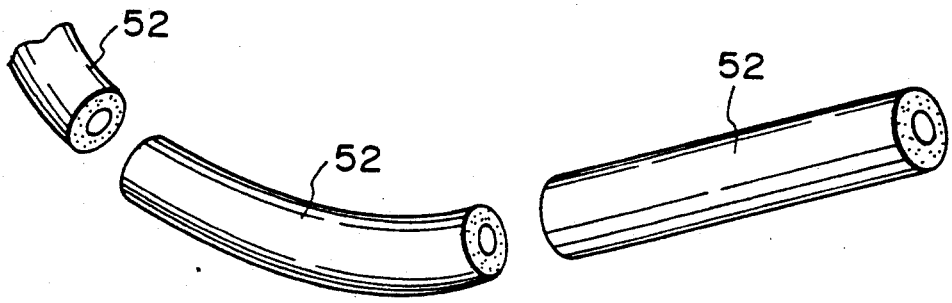
FIG. 5 is a perspective view showing tubular roller elements cut from the tubular foam product of FIG. 4.

The conductive foam rubber roller used as the charging roller 18, the developing roller 20*b*, the toner-removing roller 20*e*, or the transfer roller 22 can be produced by substantially the same processes as mentioned above. Namely, a suitable resin material, e.g., polyurethane, silicone, acrylonitrile-butadiene or the like, containing a conductive substance such as carbon or a fine metal powder, and a water-soluble foam-providing substance such as polyvinyl alcohol or methyl cellulose is extruded as a long tubular product 46, as shown FIG. 3; the extruded tubular product 46 is immersed in a body of water 48 held by a container 50, as shown in FIG. 4, so that the water-soluble foam-providing substance dissolves in the body of water 48 so that a foam structure is given to the tubular product 46; and this tubular foam product is cut into tubular roller elements 52 having a predetermined length, as shown in FIG. 5. Of course, in the extrusion process, an amount of the conductive substance is selected so that a desired resistivity can be given to the tubular foam product 48, and also an amount of the water-soluble foam-providing substance is selected so that a desired density of cells can be given to the tubular foam product 48.

Figure 6:
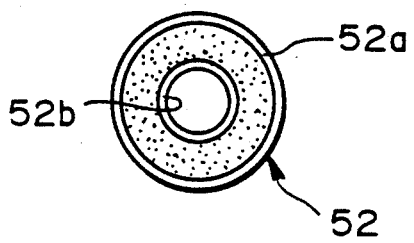
FIG. 6 is an end view of the tubular roller element of FIG. 5.

Each tubular roller element 52 is covered at an outer wall surface thereof by a solid skin layer 52*a*, and also an inner solid skin layer 52*b* is formed at an inner wall surface of a central bore of the tubular roller element 52, as shown in FIG. 6. The formation of these solid skin layers 52*a* and 52*b* is inevitable in the above-mentioned processes for the production of the tubular roller element 52, and a content of the conductive substance in the solid skin layers 52*a* and 52*b* is very small in comparison with that of the conductive substance in the internal foam structure of the tubular element 52, so that an electric resistivity of the solid skin layers 52*a* and 52*b* is considerably higher than that of the inner foam structure of the tubular roller element 52. Also, each of the solid skin layers 52*a* and 52*ba* has a thickness of from about 1 to about 5 μm, and this thickness is variable along a longitudinal axis of the tubular roller element 52.

Figure 7:
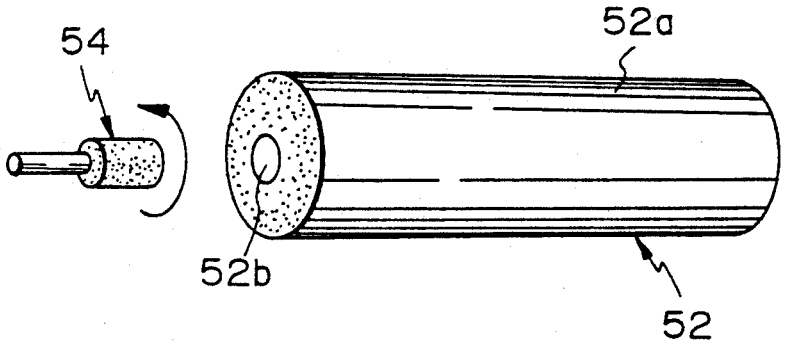
FIG. 7 is a perspective view showing a removal of an end section of an inner solid skin layer, by which a central bore of the tubular roller element is defined, by a insertion of a rotating abrasive stone thereinto.
Figure 8:
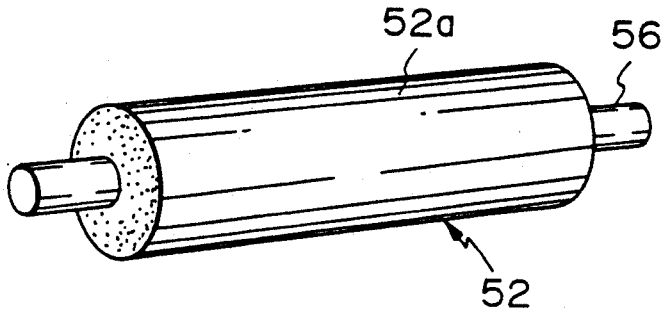
FIG. 8 is a longitudinal-sectional view of a conductive foam rubber roller according to the present invention, produced by mounting and fixing the tubular roller element of FIG. 7 on a metal shaft member.
Figure 9:
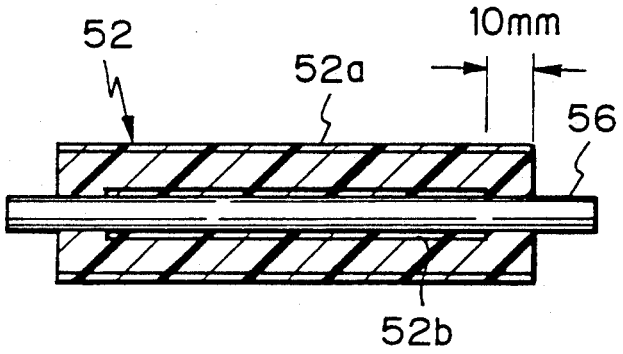
FIG. 9 is a perspective view showing the conductive foam rubber roller of FIG. 8.

According to an aspect of the present invention, the end sections of the inner solid skin layer 52*b* are removed by inserting a rotating abrasive stone 54 into the end sections of the central bore of the tubular roller element 52, as shown in FIG. 7, and this tubular roller element 52 is mounted and fixed on a metal shaft member 56 by using a suitable adhesive such as a thermosetting adhesive, to thereby produce a conductive foam rubber roller as shown in FIG. 8. As apparent from FIG. 9, in this conductive foam rubber roller, a sufficient electric contact between the tubular roller element 52 and the metal shaft member 56 can be ensured because the foam structure of the tubular roller element 54 is in direct contact with the metal shaft member 56 at the end sections of the central bore thereof. Note, the removal of the end sections of the inner solid skin layer 52*b* by the rotating abrasive stone 54 is preferably carried out over a length of about 10 mm measured from each of the end edges thereof, as shown in FIG. 9. Thereafter, the conductive foam rubber roller is finished by removing the outer solid skin layer 52*a* from the tubular roller element 52 thereof, and the removal of the outer solid skin layer 52*a* is carried out by applying an abrasive stone 58 to the tubular roller element 52 during a rotation of the conductive foam rubber roller, as shown in FIG. 10.

Figure 10:
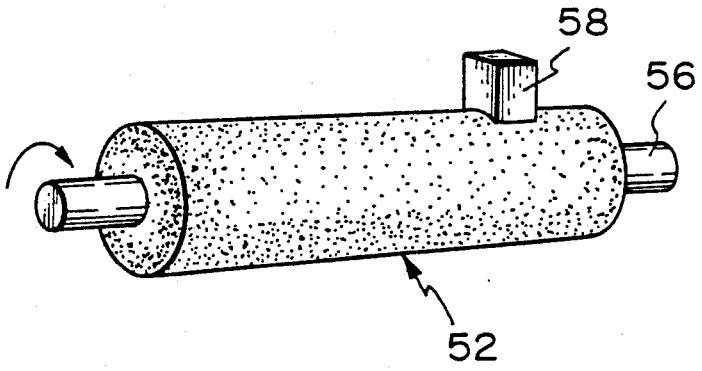
FIG. 10 is a perspective view showing a removal of an outer solid skin layer of the conductive foam rubber roller of FIG. 9 by an application of an abrasive stone.

The finished conductive foam rubber roller as shown in FIG. 10 has a desired electric characteristic when an electric energy is applied to the tubular roller element 52 through the metal shaft member 56, because sufficient electric contact is established therebetween. Namely, an electric potential of the tubular roller element 52, which is obtained by the application of the electric energy to the tubular roller element 52 through the metal shaft member 56, is invariable along the longitudinal axis of the metal shaft member 56. Accordingly, for example, when this conductive foam rubber roller is used as a developing roller, it is possible to obtain an even development of a latent image.

Figure 11:
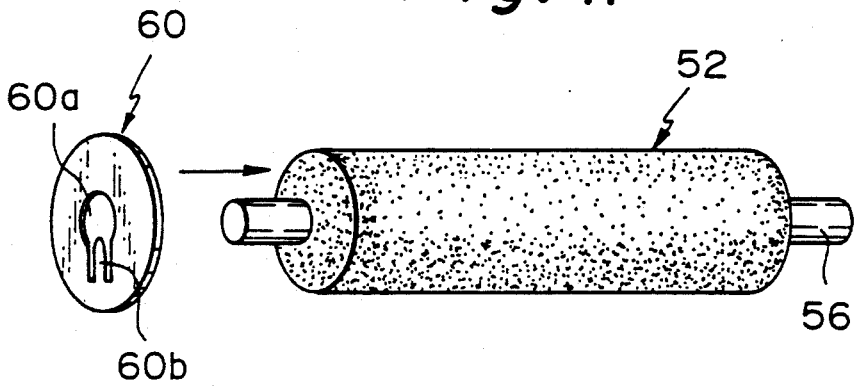
FIG. 11 is a perspective view showing a production of another type conductive foam rubber roller according to the present invention, in which a tubular roller element is fixed on a metal shaft without any removal of an inner solid skin layer from a central bore of the tubular roller element, and a metal disc-like member is inserted onto the metal shaft member.
Figure 12:
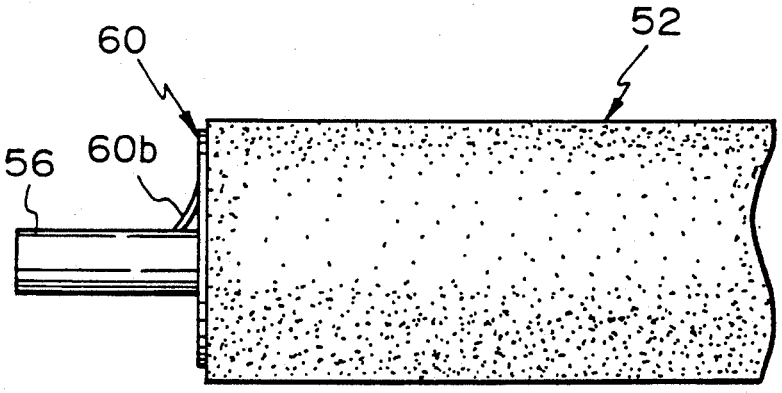
FIG. 12 is a perspective view showing the foam rubber roller obtained according to the production of FIG. 11.

FIGS. 11 and 12 show another embodiment of the conductive foam rubber roller according to the present invention, in which the tubular roller element 52 is fixed on the metal shaft member 56 without the removal of the inner solid skin layer from the central bore of the roller element 52. Nevertheless, in this embodiment, it is possible to obtain a sufficient electric contact between the tubular roller element 52 and the metal shaft member 56 by the aid of a metal disc-like member 60. This metal disc-like member 60 has a central opening 60*a* formed therein, a diameter of which is slightly larger than that of the metal shaft member 56, and a tongue element 60*b* formed therein, a free end of which is slightly projected in the central opening 60*a*. The metal disc-like member 60 is inserted onto the metal shaft member 56 from one end thereof, as shown in FIG. 11, and is then abutted against an end face of the tubular roller element 52, as shown in FIG. 12. There is no solid skin layer at the end faces of the tubular roller element 52, so that a sufficient electric contact can be established between the metal shaft member 56 and the foam structure of the tubular roller element 52. Also, the metal disc-like member 60 cannot slip out of the metal shaft member 56 because the tongue element 60*b* is in engagement with the surface of the metal shaft member 56. Note, of course, that removal of the outer solid skin layer of the tubular roller element 52 may be carried out before or after the attachment of the metal disc-like member 60 thereto.

Figure 13:
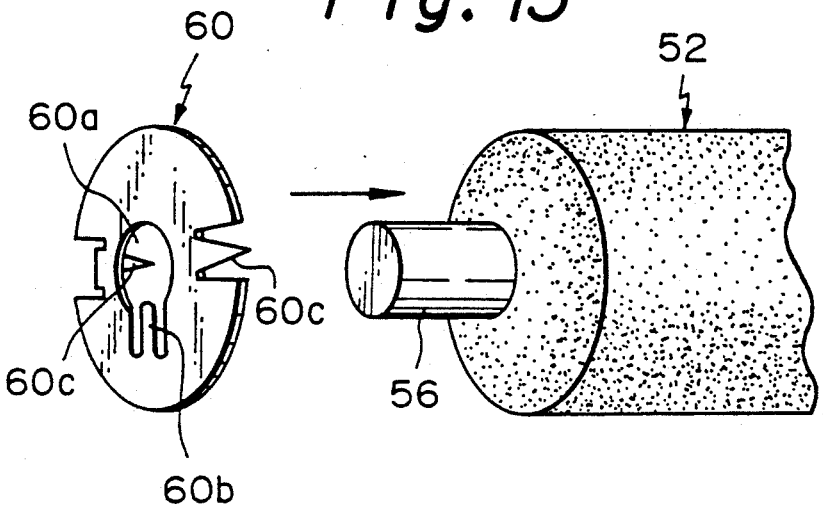
FIG. 13 is a perspective view showing a modification of the production of FIG. 11, using another type metal disc-like member.
Figure 14:
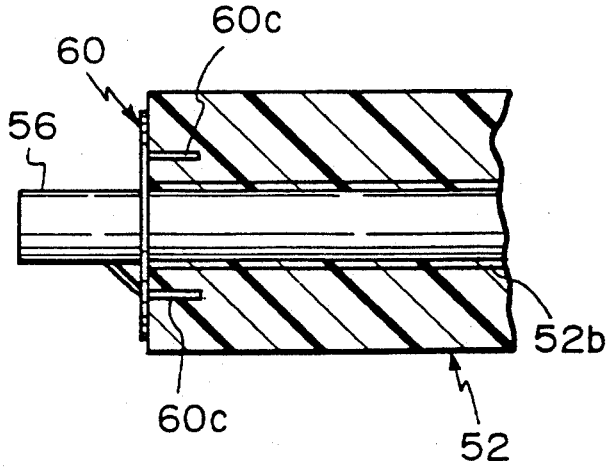
FIG. 14 is a perspective view showing the conductive foam rubber roller obtained according to the production of FIG. 13.

FIGS. 13 and 14 show a modification of the embodiment as shown in FIGS. 11 and 12. In this modified embodiment, the metal disc-like has a pair of nail-like elements 60*c*, 60*c* diametrically formed therein and bent to be oriented toward the end face of the tubular roller element 52, as shown in FIG. 13, and thus the nail elements 60*c*, 60*c* are penetrated into the foam structure of the tubular roller element 52 when the metal disc-like member is abutted against the end face thereof, as shown in FIG. 14. According to this embodiment, the electric contact between the tubular roller element 52 and the metal shaft member 56 is securely ensured due to the penetration of the nail-like elements 60*c*, 60*c* into the foam structure of the tubular roller element 52.

Figure 15:
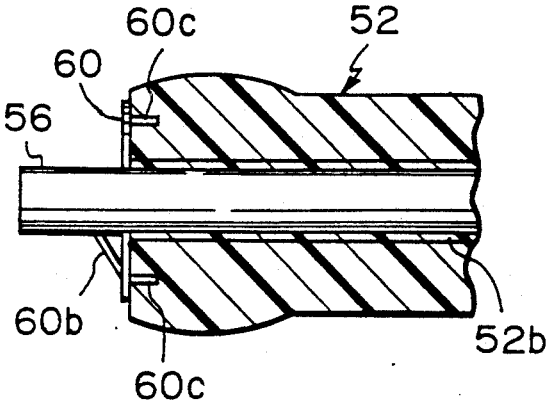
FIG. 15 is a longitudinal-sectional view showing the conductive foam rubber roller of FIG. 14, in which an end portion of the tubular roller element is expanded by excessively pressing the metal disc-like member against the end face of the tubular roller element.
Figure 16:
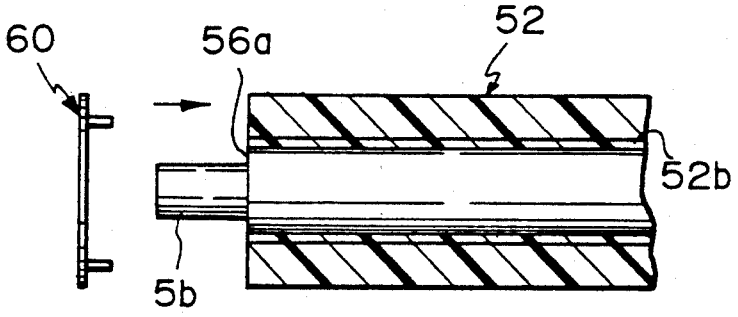
FIG. 16 is a longitudinal-sectional view showing a production of yet another type conductive foam rubber roller according to the present invention, in which an end portion of the metal shaft member has a smaller diameter than that of the middle portion thereof on which the tubular roller element is fixed, so that an annular shoulder is formed in the metal shaft member to be flush with the end face of the tubular roller element.
Figure 17:
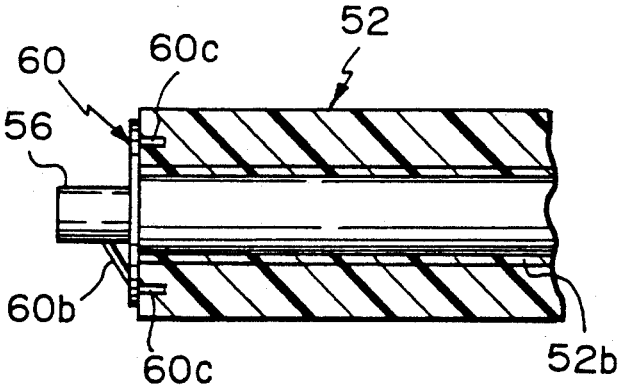
FIG. 17 is a longitudinal-sectional view showing the conductive foam rubber roller obtained according to the production of FIG. 16.

In the embodiment as shown in FIGS. 11 and 12, if the metal disc-like member 60 is excessively pressed against the end face of the tubular roller element 52, the end portion thereof is expanded as exaggeratedly shown in FIG. 15. Of course, the conductive foam rubber roller having the expanded end portions cannot be used as a charging roller, developing roller, toner-removing roller, or transfer roller. An embodiment as shown in FIGS. 16 and 17 is directed to a prevention of the expansion of the end portions of the tubular roller element 52. In this embodiment, an end portion of the metal shaft member 56 has a smaller diameter than that of the middle portion thereof on which the tubular roller element 52 is fixed, so that an annular shoulder 56*a* is formed in the metal shaft member 56 to be flush with the end face of the tubular roller element 52, as shown in FIG. 16. On the other hand, the central opening of the metal disc-like member 60 has a diameter slightly larger that of the end portion of the metal shaft member 56 so that, although the metal disc-like member 60 is inserted onto the end portion thereof and is pressed against the end face of the tubular roller element 52, it cannot be moved beyond the annular shoulder 56*a*, whereby the expansion of the end portions of the tubular roller element 52 can be prevented.

Finally, it will be understood by those skilled in the art that the foregoing description is of preferred embodiments of the present invention, and that various changes and modifications can be made without departing from the spirit and scope thereof.

I claim:

1. A conductive foam rubber roller used in an image formation apparatus comprising:

a conductive tubular foam rubber roller element having a central bore defined by a solid skin layer having an electric resistivity considerably higher than that of a conductive foam structure of said conductive tubular foam rubber element;

a conductive shaft member on which said conductive foam rubber roller element is mounted and fixed; and an electric contact establishing means provided between said conductive tubular foam rubber roller element and said conductive shaft member for establishing a sufficient electric contact therebetween.

2. A conductive foam rubber roller as set forth in claim 1, wherein said electric contact establishing means comprises a removal of end sections of said solid skin layer from said conductive tubular foam rubber roller element such that the conductive foam structure of said conductive tubular foam rubber roller element is in direct contact with said conductive shaft member at end sections of the central bore thereof.

3. A conductive foam rubber roller as set forth in claim 1, wherein said electric contact establishing means comprises a conductive disc-like member having a central opening formed therein to receive said conductive shaft member, said conductive disc-like member being inserted onto said conductive shaft member to be abutted against an end face of said conductive tubular foam rubber roller element, whereby sufficient electric contact can be established between said conductive tubular foam rubber roller element and said conductive shaft member.

4. A conductive foam rubber roller as set forth in claim 3, wherein said conductive disc-like member has a tongue element formed therein, a free end of which is slightly projected in the central opening of said conductive disc-like member, whereby said conductive disc-like member is prevented from slipping out of said conductive shaft member by an engagement of said tongue element with a surface of said conductive shaft member.

5. A conductive foam rubber roller as set forth in claim 3, said conductive disc-like member has a nail-like element formed therein and bent to be oriented toward the end face of said conductive tubular foam rubber roller element, and said nail-like element is penetrated into the conductive foam structure thereof when said conductive disc-like member is abutted against the end face of said conductive tubular foam rubber roller element.

6. A conductive foam rubber roller as set forth in claim 3, wherein an end portion of said conductive shaft member has a smaller diameter than that of a middle portion thereof on which said conductive tubular foam rubber roller element is fixed, so that an annular shoulder is formed in said conductive shaft member to be flush with the end face of said conductive tubular foam rubber roller element, and the central opening of said conductive disc-like member has a size so as to receive only the end portion of said conductive shaft member, whereby said conductive disc-like member is prevented from being moved beyond the annular shoulder of said conductive shaft member.

7. A conductive foam rubber roller as set forth in claim 1, wherein said conductive foam rubber roller is used as a charging roller for producing an electrically charged zone on an electrostatic latent image carrying body in said image formation apparatus.

8. A conductive foam rubber roller as set forth in claim 1, wherein said conductive foam rubber roller is used as a developing roller for electrostatically developing an electrostatic latent image with a toner developer in said image formation apparatus.

9. A conductive foam rubber roller as set forth in claim 1, wherein said conductive foam rubber roller is used as a toner-removing roller for mechanically removing a toner developer, which is not used for a development of an electrostatic latent image, from a developing roller in said image formation apparatus.

10. A conductive foam rubber roller as set forth in claim 1, wherein said conductive foam rubber roller is used as a transfer roller for electrostatically transferring a developed toner image from an electrostatic latent image carrying body to a recording medium such as a paper in said image formation apparatus.

11. An image formation apparatus comprising:

an electrostatic latent image carrying body means for carrying an electrostatic latent image formed thereon; and a developing roller means for entraining the developer to bring an electrostatically-charged toner developer to said electrostatic latent image carrying body means for a development of the electrostatic latent image with the toner developer;

a toner-removing roller means for removing a toner developer not used for the development of the electrostatic latent image from said developing roller; and a transfer roller means for electrostatically transferring a charged toner image developed by said developing roller means from said electrostatic latent image carrying body means to a recording medium such as a paper, wherein at least one of said developing roller means, said toner-removing roller means, and said transfer roller means includes a conductive foam rubber roller which comprises:

a conductive tubular foam rubber roller element having a central bore defined by a solid skin layer having an electric resistivity considerably higher than that of a conductive foam structure of said conductive tubular foam rubber element;

a conductive shaft member on which said conductive foam rubber roller element is mounted and fixed; and an electric contact establishing means provided between said conductive tubular foam rubber roller element and said conductive shaft member for establishing a sufficient electric contact therebetween.

12. An electrophotographic recording apparatus comprising:

an electrostatic latent image carrying body means;

a charging roller means for producing an electrically-charged zone on said electrostatic latent image carrying body means;

an optical writing means for optically writing an electrostatic latent image on the electrically-charged zone of said electrostatic latent image carrying body means;

a developing roller means for entraining the developer to bring an electrostatically-charged toner developer to said electrostatic latent image carrying body means for a development of the electrostatic latent image with the toner developer;

a toner-removing roller means for removing a toner developer not used for the development of the electrostatic latent image from said developing roller; and a transfer roller means for electrostatically transferring a charged toner image developed by said developing roller means from said electrostatic latent image carrying body means to a recording medium such as a paper, wherein at least one of said charging roller means, said developing roller means, said toner-removing roller means, and said transfer roller means includes a conductive foam rubber roller which comprises:

a conductive tubular foam rubber roller element having a central bore defined by a solid skin layer having an electric resistivity considerably higher than that of a conductive foam structure of said conductive tubular foam rubber element;

a conductive shaft member on which said conductive foam rubber roller element is mounted and fixed; and an electric contact establishing means provided between said conductive tubular foam rubber roller element and said conductive shaft member for establishing a sufficient electric contact therebetween.

* * * * *

UNITED STATES PATENT AND TRADEMARK OFFICE

CERTIFICATE OF CORRECTION

PATENT NO. : 5,241,343

DATED : Aug. 31, 1993

INVENTOR(S) : NISHIO

It is certified that error appears in the above-indentified patent and that said Letters Patent is hereby corrected as shown below:

Col. 5, line 53, change "the foam" to --the conductive foam--.

Col. 6, line 41, change "of – 600 volts" to --of about – 600 volts--.

Signed and Sealed this

Twenty-fourth Day of October, 1995

*Attest:*

*Attesting Officer*

BRUCE LEHMAN

*Commissioner of Patents and Trademarks*